United States Patent [19]

Thomas

[11] Patent Number: 4,632,094

[45] Date of Patent: Dec. 30, 1986

[54] ELECTRO-MECHANICAL HEART COMPRESSOR SYSTEM

[76] Inventor: August A. Thomas, 1321 Roxboro Rd., Baltimore, Md. 21237

[21] Appl. No.: 715,834

[22] Filed: Mar. 25, 1985

[51] Int. Cl.[4] ..... A61H 7/00

[52] U.S. Cl. ..... 128/52; 100/257; 128/55

[58] Field of Search ..... 128/24.2, 24 R, 24 A, 128/25 B, 28, 32–40, 45, 46, 47, 50–53, 55, 56, 57, 59, 61, 62, 65, 66, 67; 272/96; 15/28, 29; 100/257

[56] References Cited

U.S. PATENT DOCUMENTS

| | | | |
|---|---|---|---|
| 153,981 | 8/1874 | Powers | 100/257 |
| 156,866 | 11/1874 | Wright | 100/257 |
| 367,012 | 7/1887 | Scarff | 100/257 |
| 514,204 | 2/1894 | Taylor | 100/257 |
| 587,891 | 8/1897 | Walker | 128/28 |
| 715,732 | 12/1902 | Garey | 128/40 |
| 1,796,444 | 3/1931 | Delleva | 128/55 |
| 3,626,934 | 12/1971 | Andias | 128/55 |
| 4,231,126 | 11/1980 | Hurkett | 128/33 |

FOREIGN PATENT DOCUMENTS

| | | | |
|---|---|---|---|
| 422674 | 1/1911 | France | 100/257 |
| 1331573 | 5/1963 | France | 128/53 |
| 1563994 | 3/1969 | France | 128/53 |
| 10471 | of 1895 | United Kingdom | 100/257 |
| 10472 | of 1895 | United Kingdom | 100/257 |
| 1040753 | 9/1966 | United Kingdom | 128/53 |

*Primary Examiner*—Clyde I. Coughenour

*Attorney, Agent, or Firm*—John F. McClellan, Sr.

[57] ABSTRACT

An electro-mechanical heart compressor system for use in rendering first aid in cases of heart stoppage provides a constant-stroke-length, motor driven reciprocating plunger extending downwardly through a first or upper mounting plate. A second or lower mounting plate with uprights at the ends provides a support for a patient and adjustably holds above it the upper mounting plate in position with the plunger above a mark designating the proper location for the patient's heart. The reciprocation is provided by an electric motor acting through a crank and slotted yoke adjustably affixed to the shaft of the plunger, which shaft is held in guides.

1 Claim, 6 Drawing Figures

ELECTRO-MECHANICAL HEART COMPRESSOR SYSTEM

FIELD OF THE INVENTION

This invention relates generally to lifesaving instrumentation and particularly to apparatus for cyclically compressing the human heart in instances when the heart has stopped beating.

BACKGROUND OF THE INVENTION

When the human heart stops beating, death can occur within a matter of minutes, for example, in an average case, seven minutes.

First aid techniques have been developed for compressing the heart, in which the patient's chest wall is cyclically pressed down and released, by hand.

To be effective, this treatment must often be repeated at about sixty pumps per minute for a period as long as possible until help arrives. Unless the one rendering first aid is in good condition such treatment may not be sustainable and may be hazardous to the one rendering first aid.

Even if the one rendering first aid is in good condition, over a period of sustained exertion the motion may not continue in an optimum direction or with optimum force. Training varies, as do the abilities of the trainees.

All in all, the manual method of heart compression leaves much to chance, and it is known by the inventor that elaborate and complex and costly equipment has been sold for the purposes herein, but of a different design and operation.

SUMMARY OF THE INVENTION

A principal object of this invention is therefore to provide a heart compressor system that can be used as a superior substitute for the method of pressing on the chest to produce heart compression manually.

Further aspects are to provide a system as described can be quickly set up and applied to a patient, that is positive in adjustment, and that is reliable in operation.

Still further objects are to provide a system as described that is easy to learn to use and after that is easy to use, and that is safe and quiet.

Yet further objects are to provide a system as described that is simple and inexpensive to make, that can be made in good part of readily available, time proven components, that is economical and durable, that folds compactly for transport, is light in weight, and can be operated from convenient, commonly available power supplies.

In brief summary given as cursory description and not as limitation, an electro-mechanical heart compressor system for use in rendering first aid in cases of heart stoppage provides a constant-stroke-length, motor driven reciprocating plunger extending downwardly through a first or upper mounting plate. A second or lower mounting plate with uprights at the ends provides a support for a patient and adjustably holds above it the upper mounting plate in position with the plunger above a mark designating the proper location for the patient's heart. The reciprocation is provided by an electric motor acting through a crank and slotted yoke adjustably affixed to the shaft of the plunger, which shaft is held in guides.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
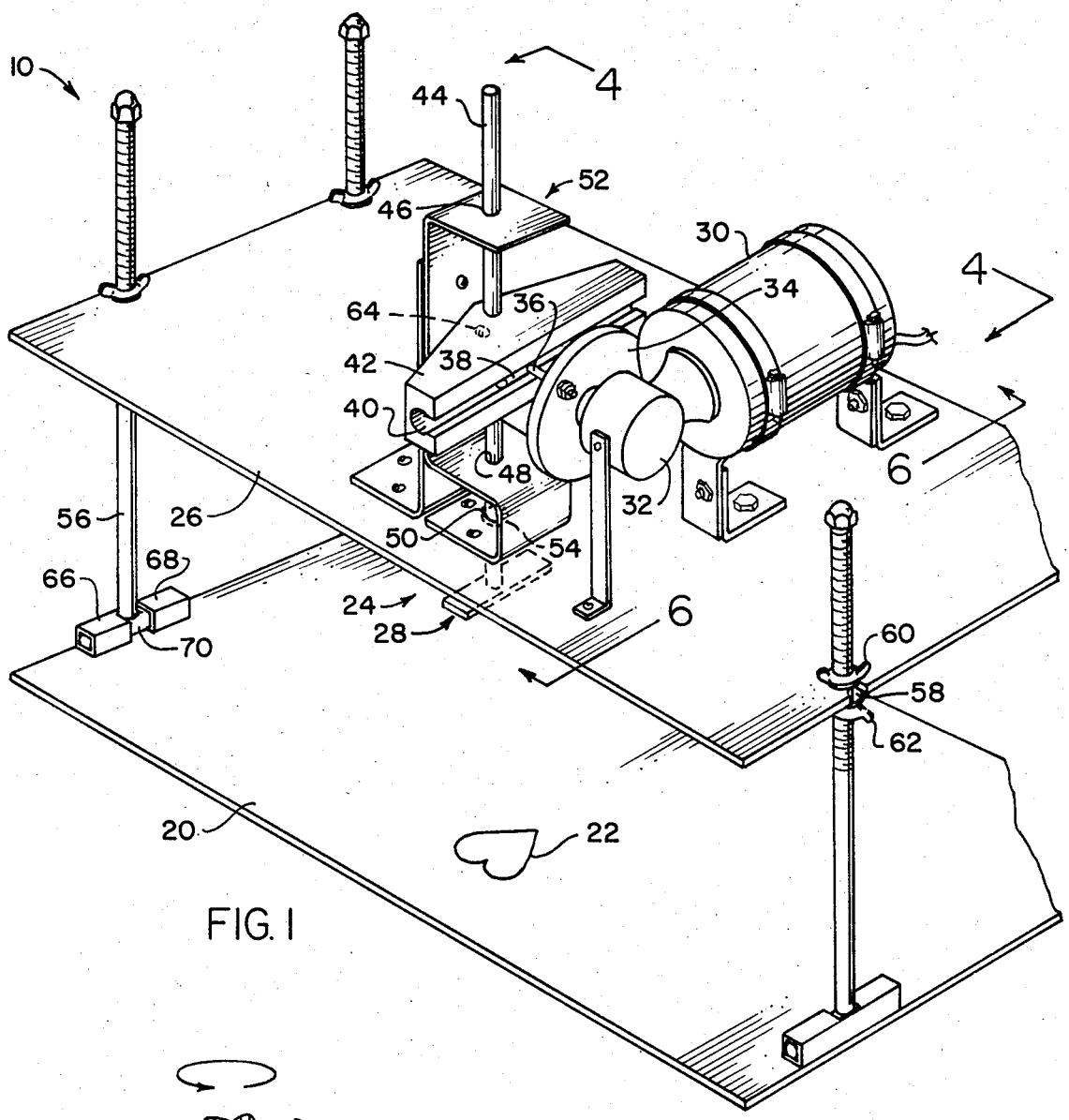
FIG. 1 is a fragmentary perspective view of a preferred embodiment of the system with covers removed but otherwise ready for use.

FIG. 1 shows embodiment 10 of the invention in front perspective view. The patient is placed on the patient's back on lower mounting plate 20, with heart located over an indicium 22 on the lower mounting plate, so that it is aligned under and in the path of reciprocation of plunger 24. The plunger 24 is mounted on upper mounting plate 26, which is the same size as the lower mounting plate 20. The plunger has a transverse plate 28 on the lower end to provide broad-area contact with the patient's chest, against which the transverse plate 28 presses down and releases to provide first aid pumping action on the heart when needed.

A motor 30, which is a D. C. motor powered from a vehicle battery or other battery, or through a transformer and rectifier from an A. C. source, drives a gearbox 32 so that a crank 34 on the output shaft of the gearbox rotates at 60 R.P.M. The crank has a pin 36 that engages a slider 38 integral with the crank pin and held in a slot 40 in a yoke 42 fixed transversely on the plunger rod 44 which moves vertically in guide holes 46, 48, 50, in guide frame 52. The plunger rod preferably passes down through an oversize hole 54 in the upper mounting plate.

For safety, the moving parts are, except for the lower end of the plunger 24, above the upper mounting plate and covered with covers provided.

Quick-assembly provisions for the system permit the patient to be laid on the lower mounting plate 20 before the upper mounting plate 26 is attached.

In operating sequence: (a) the lower mounting plate 20 is laid on the floor, ground, or other surface; and (b) erected are pairs of supports 56 that normally are carried folded inward over the lower mounting plate 20, flat to the ground so that there is access all around, for the next step: (c) in which the patient is laid on the lower mounting plate, heart where indicated by indicium 22.

Next, (d) the supports 56 are fixed in upright position, by a means to be described in reference to this and the next figure; (e) the end slots 58 of the upper mounting plate 26 are engaged in the respective spaces between the paired, opposed wingnuts 60, 62 held on the threaded supports 56 which are sufficiently flexible outwardly to permit this; and the wingnuts are tightened against the upper mounting plate 26, for secure, detachable engagement. If height adjustment of the upper mounting plate is needed, the wing nuts are spun to the desired adjusted position before being tightened.

Next, (g) the motor is turned on, so that the patient's chest receives the required massage.

Stroke length is constant, and velocity is sinusoidal, simulating manual first aid.

Figure 2:
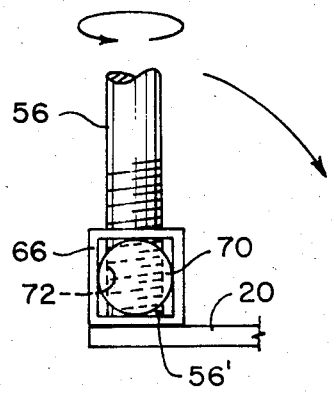
FIG. 2 is a fragmentary end-view detail of the operating relations of an upright and a member for mounting the upright to a base.

FIG. 2 shows, together with the first figure, how each support is pivotally secured and is individually and instantly positioned upright for use or folded for transport and storage. A piece 66, of square tubing aligned with the ends of the lower mounting plate 20 is affixed as by welding or bolting to the lower mounting plate 20. In each piece is a transverse cylindrical nut 70 made of a piece of rod. This nut longitudinally fits the square pipe interior and receives between the parts of square tubing, in a threaded hole 72 through the nut, the threaded rod, which comprises the support 56. To fix the support upright as shown, the support is screwed down until the squared-off lower end 56' jams against the bottom of the square tube. To release and fold the support 56 it is simply unscrewed enough for the end 56' to retract into the transverse cylindrical nut 70, permitting the nut 70 to turn in the square tubing 66, (arrows).

Figure 3:
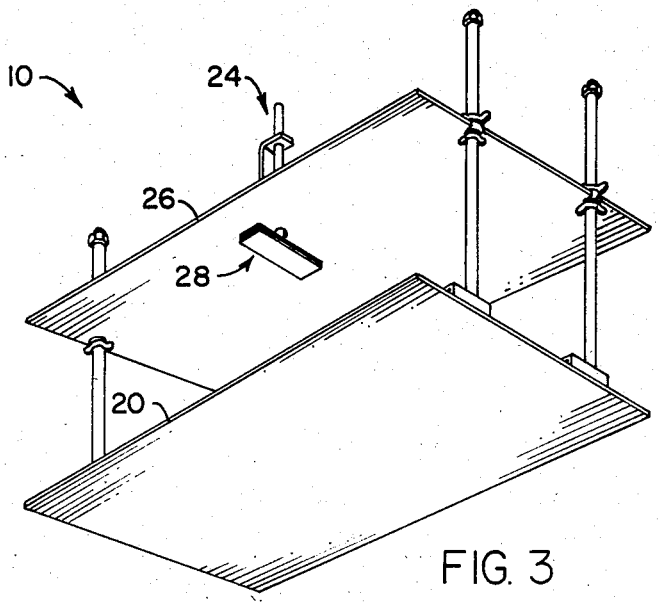
FIG. 3 is a lower side perspective view.

FIG. 3 shows the transverse plate 28 supported by the plunger 24 and the otherwise machinery-free underside of the upper mounting plate 26, together with the underside of the lower mounting plate 20, that is completely free of features that might cause the system to snag on something or to teeter.

Figure 4:
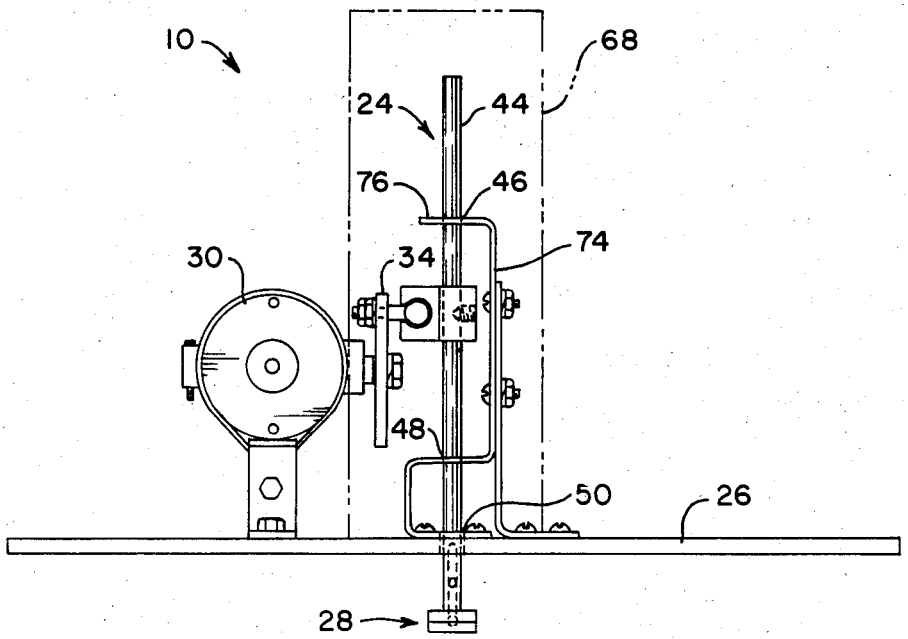
FIG. 4 is a view taken at 4—4, FIG. 1.

FIG. 4 shows the rear view elevational relation of the motor 30, which may be a vehicle windshield wiper motor for economy, reliability and adjustability, to the crank 34. The guide frame 74 of flat steel is bent and affixed to the upper mounting plate 26 so that the guide holes 46, 48, 50 for the plunger rod 44 are in horizontal portions of the guide frame, as at 76. These are simple and inexpensive, and provide flexible guiding for the plunger rod 44 and transverse plate 28. A compact cover 68 may be used to enclose all moving parts at little expense.

Figure 5:
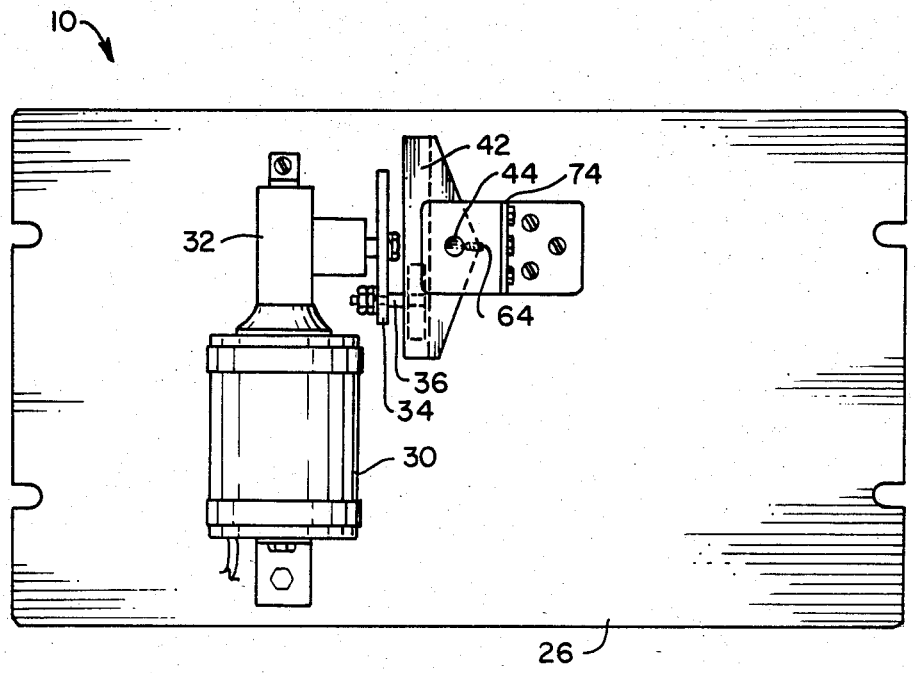
FIG. 5 is a top plan view of the upper portion of the embodiment.

FIG. 5 shows in top plan view the relation of the motor 30, gear box 32, crank 34, pin 36, yoke 42, plunger rod 44, set screw 64 that connects yoke 42 to rod 44, guide frame 74, and upper plate 26.

Figure 6:
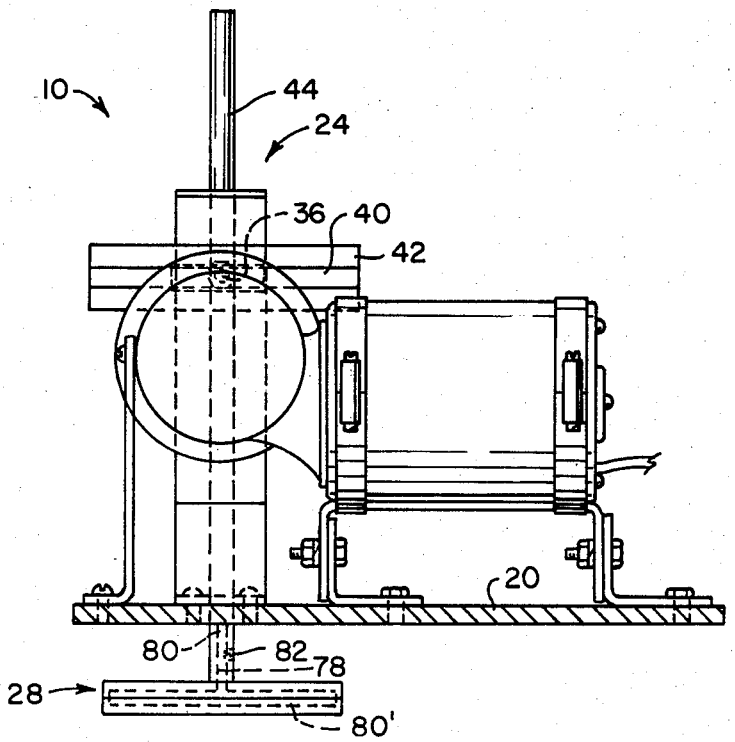
FIG. 6 is a view taken at 6—6, FIG. 1.

FIG. 6 shows the sturdy but lightweight and compact mechanism on the upper mounting plate 20, with the plunger 24 at the upper limit of travel as indicated by the easily seen relation of pin 36 in slot 40 in the yoke. This good visibility may be especially valuable in setting initial clearance at a patient's chest. Also shown is a further feature of the plunger 24. The plunger rod 44 may have an axial hole 78 receiving an upward protrusion 80 integral with the transverse plate 28, at 82. A set screw holds the transverse plate 28 to plunger rod 44. The upward protrusion 80 preferably is a part of a "T"-shaped structure of welded rod, the horizontal portion 80' of which forms the core of the transverse plate.

From the foregoing, the combination of ready visibility of all parts for inspection, simplicity and efficient function, will be apparent.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. A system for use in cyclically compressing and releasing a human heart through the chest wall of a patient and having a plunger, means for quickly positioning the plunger relative the chest wall portion above the heart of a patient, means for reciprocating the plunger and cyclically pressing down and releasing said chest wall portion and thereby cyclically compressing and releasing the heart of the patient, the improvement comprising: the means for quickly positioning comprising: the system including an upper mounting plate, means affixing the means for reciprocating on the upper mounting plate with a portion of the plunger protruding downwardly, a lower mounting plate, a plurality of supports, means pivotally securing the plurality of supports to the lower mounting plate, means for detachably engaging each of said plurality of supports to the upper mounting plate; the means for detachably engaging including means for adjusting the height of said engaging; the means for quickly positioning further comprising an indicium on the lower mounting plate below said plunger, the means for detachably engaging including the means for pivotally securing permitting the plurality of supports to fold inwardly over the lower mounting plate, the upper mounting plate being substantially the same size as the lower mounting plate and having ends with slots therein, means for holding the plurality of supports in upright position, the plurality of supports when held in upright position being flexible outwardly past the upright position for springing back and fitting respectively into said slots, each support having screwthreads at an end thereof, the means for holding the plurality of supports in upright position including on each support a cylindrical nut receiving in a threaded hole transversely therethrough the screwthreads of the support, a square tube affixed to the lower mounting plate and containing the cylindrical nut rotatably therein, and the support being rotatable for screwing the threaded end down against the lower mounting plate, thereby holding the support upright.

* * * * *